US005905803A

United States Patent [19]

Dou et al.

[11] Patent Number: 5,905,803

[45] Date of Patent: May 18, 1999

[54] FLUSH-PORTING METHOD AND DEVICE FOR REDUCTION OF WIND-INDUCED NOISE IN A MICROPHONE

[75] Inventors: Xinyu Dou, Fox River Grove, Ill.; Julio Castaneda, Coral Springs, Fla.; Xiaohua Wu, Lake Zurich, Ill.; David Zak, Palatine, Ill.; Chao-pin Yeh, Schaumburg, Ill.; Karl W. Wyatt, Cary, Ill.

[73] Assignee: Motorola, Inc., Schaumburg, Ill.

[21] Appl. No.: 08/818,114

[22] Filed: Mar. 14, 1997

[51] Int. Cl.[6] ..... H04R 25/00

[52] U.S. Cl. ..... 381/359; 381/355; 381/344

[58] Field of Search ..... 381/355, 357, 381/359, 360, 189, 170, 177, 344

[56] References Cited

U.S. PATENT DOCUMENTS

| | | | |
|---|---|---|---|
| 3,947,646 | 3/1976 | Saito | 381/359 |
| 4,920,564 | 4/1990 | Allkins | 381/355 |
| 5,263,093 | 11/1993 | Nakamura et al. | 381/357 |
| 5,442,713 | 8/1995 | Patel et al. | 381/357 |

*Primary Examiner*—Huyen Le
*Attorney, Agent, or Firm*—Darleen J. Stockley

[57] ABSTRACT

The present invention provides a method (600) and device (400) for minimizing wind-induced noise in a microphone. The device includes: a housing (412) having a recessed area shaped to accommodate a microphone transducer (410); the microphone transducer (410), situated within the recessed area such that a thin film situated over the microphone transducer is flush with/overlaying a top of the recessed area and affixed at least to the sides of the recessed area, for receiving sound; and the thin film (402) has at least one aperture (404, . . . 406) for allowing sound to impinge on the microphone transducer (410), and has a minimal thickness that maintains structural integrity.

8 Claims, 2 Drawing Sheets

—PRIOR ART—

FLUSH-PORTING METHOD AND DEVICE FOR REDUCTION OF WIND-INDUCED NOISE IN A MICROPHONE

FIELD OF THE INVENTION

The present invention relates to acoustic performance in a microphone and more particularly, to acoustic performance in a microphone under windy conditions.

BACKGROUND OF THE INVENTION

Conventional microphone porting typically includes a round sound hole opening that is typically 1–2 millimeters deep and a cavity (104), as shown in FIG. 1, numeral 100, that is typically 1–2 millimeters deep. The diameter of the sound hole opening (102) is determined by a desired overall frequency response curve which depends on the size of the sound hole opening (102), the volume of the cavity (104), and the characteristics of a microphone transducer (106) that is placed at the bottom of the cavity (104). When a handset having a microphone with a round opening and a cavity is utilized under windy conditions, wind-induced noise may decrease microphone performance in the form of fluttering background noise which can render the voice sound unintelligible.

Wind-induced noise arises from the hydrodynamic instability of the flow of air over the cavity (104) sound hole opening (102). As shown in FIGS. 2–3, numerals 200 and 300, the wind flow (202) across an opening (206) produces separation vortices (204) that produce a hyperbolic wind velocity profile (302) that is unstable.

Thus, there is a need for a method and device for minimizing wind-induced noise in microphones.

DETAILED DESCRIPTION OF A PREFERRED EMBODIMENT

Figure 1:
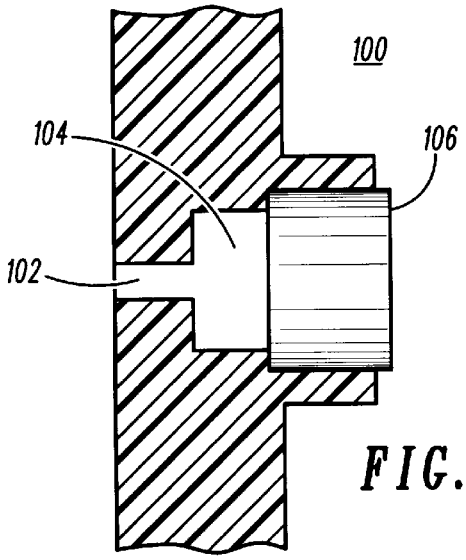
FIG. 1 is a schematic representation of a conventional microphone as is known in the art.
Figure 2:
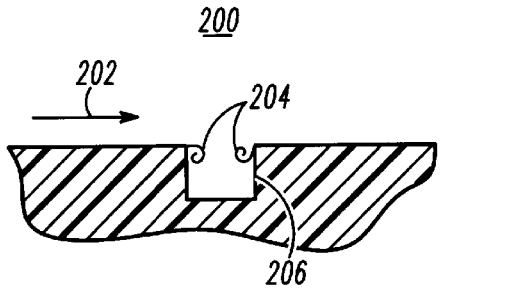
FIG. 2 is a schematic representation of a sound hole of a conventional microphone with separation vortices formed by wind flow, as is known in the art.
Figure 3:
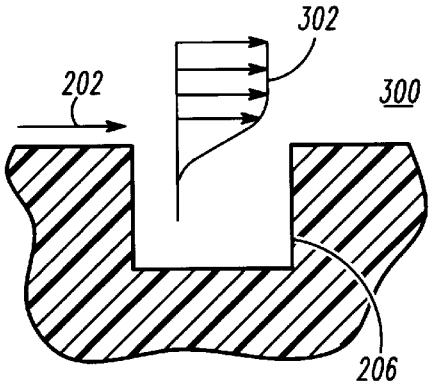
FIG. 3 is a schematic representation of a hyperbolic wind velocity profile produced by wind flow across a sound hole of FIG. 2, as is known in the art.

The present invention minimizes wind-induced noise for a microphone transducer (410) by affixing the microphone transducer (410) flush with the outer edge of an opening in the housing (412) of a two-way radio, cellular phone or the like and covering the transducer (410) with a thin film (402) containing at least one aperture (404, . . . 406). In the conventional arrangement, the cavity and opening combine to create a resonance frequency which can hamper microphone response by introducing a peak to the audible range. The invention arrangement described herein provides a small sound hole or a plurality of small sound holes and also eliminates the cavity. The combination of the flush mounting and elimination of the cavity provides the optimal response for microphone.

Generally adhesive (408) can be used to affix the microphone transducer (410) to the sides of a hole in the housing (412) of the two-way radio, cellular phone, etc.. Then, a thin film (402) such as a thermoplastic polycarbonate or sheet metal is applied over the microphone transducer (410) such that a small overlap of the thin film (402) seals the microphone transducer (410) into the housing (412), leaving only at least one predetermined aperture in the thin film (402) to allow sound to reach the microphone transducer (410). For example, in a preferred embodiment, the thin film is typically approximately 0.1 millimeter thick. However, the invention may be implemented with a thin film with a thickness from approximately 0.1 to approximately 1.0 millimeter.

If adhesive is not used, the microphone may be affixed to the desired position by placing a rubber boot on the microphone transducer and press-fitting it to the housing.

Figure 4:
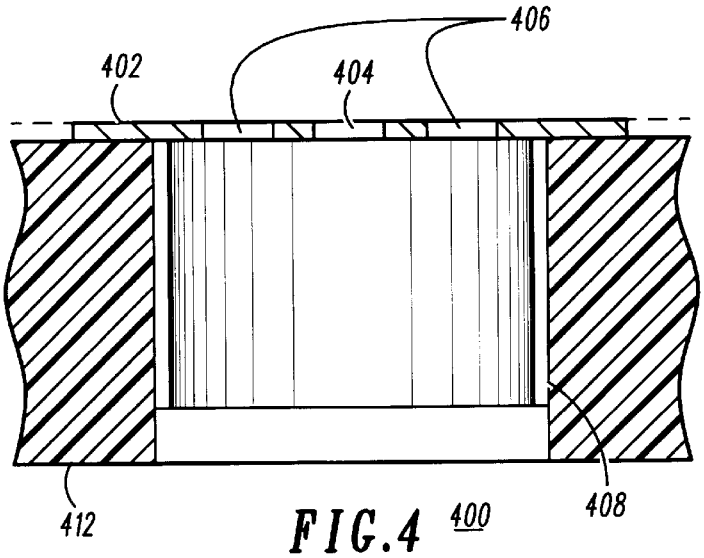
FIG. 4 is a schematic representation of one embodiment of a device in accordance with the present invention.

FIG. 4, numeral 400, is a schematic representation of one embodiment of a device in accordance with the present invention for minimizing wind-induced noise in a microphone.

The device includes: A) a housing (412) having a recessed area shaped to accommodate a microphone transducer (410); B) the microphone transducer (410), situated within the recessed area such that a thin film situated over the microphone transducer is flush with/overlaying a top of the recessed area and affixed at least to the sides of the recessed area, for receiving sound; and C) the thin film (402) situated over the microphone transducer (410) wherein the thin film (402) has at least one aperture for allowing sound to impinge on the microphone transducer (410), wherein the thin film (402) has a minimal thickness that maintains structural integrity. Typically, the thin film (402) has a thickness of 0.1 to 1.0 millimeters and may overlap/be flush with the sides of the recessed area. The thinner the thin film (402), the better the wind-noise minimization. In particular, where the wind-induced noise is caused by wind exceeding 5 miles per hour, the present invention clearly minimizes wind-noise in comparison to the prior art.

Though a single aperture (404) in the thin film (402) may be utilized, clearly a plurality of apertures may also be utilized. The apertures are typically round, square, rectangular, or oblong.

Figure 5:
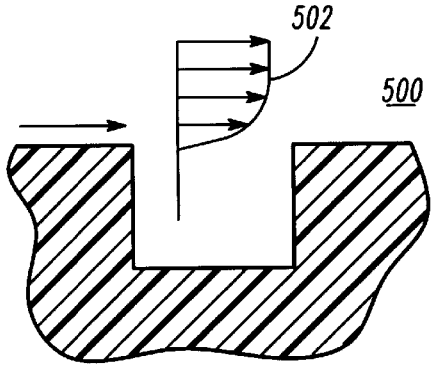
FIG. 5 is a schematic representation of a parabolic wind velocity profile produced by wind flow across a flush surface for a flush-ported microphone transducer of FIG. 4.

FIG. 5, numeral 500, is a schematic representation of a parabolic wind velocity profile (502) produced by wind flow across a flush surface for a flush-ported microphone transducer of FIG. 4. The parabolic wind velocity profile is a more stable profile, thus minimizing wind-noise.

Figure 6:
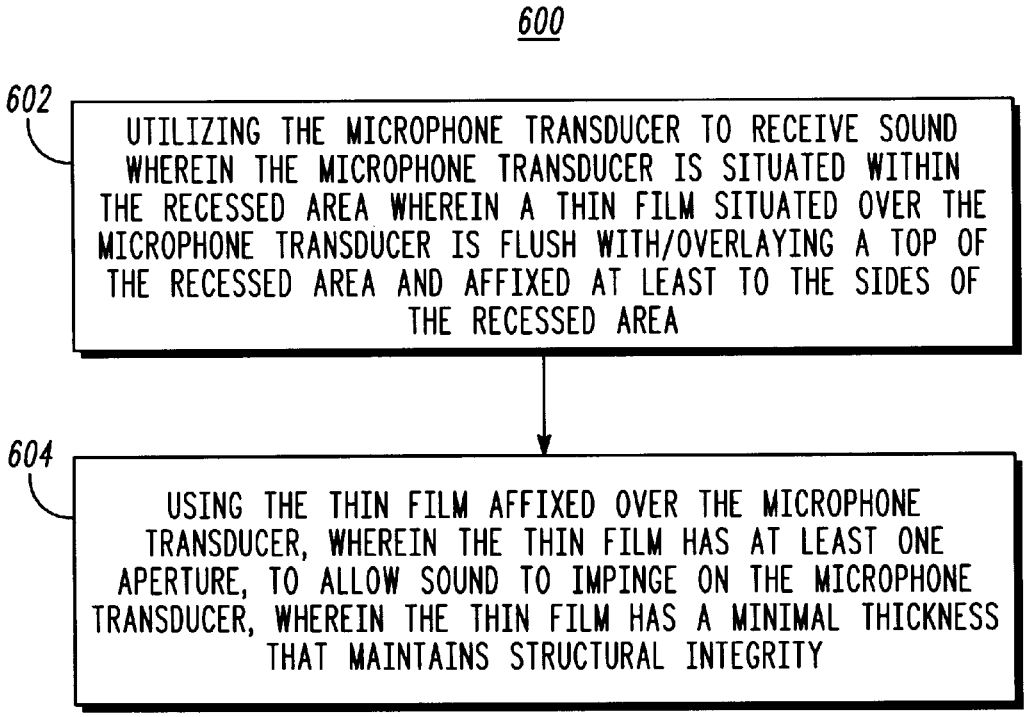
FIG. 6 is a flow chart of one embodiment of steps in accordance with the method of the present invention.

FIG. 6, numeral 600, is a flow chart of one embodiment of steps in accordance with the method of the present invention. The method provides a device for minimizing wind-induced noise in a microphone and includes the steps of: for a housing having a recessed area shaped to accommodate a microphone transducer, A) utilizing (602) the microphone transducer to receive sound, wherein the microphone transducer is situated within the recessed area wherein a thin film situated over the microphone transducer is flush with/overlaying a top of the recessed area and affixed at least to the sides of the recessed area; and B) using (604) the thin film affixed over the microphone transducer, wherein the thin film has at least one aperture, to allow sound to impinge on the microphone transducer, and wherein the thin film has a minimal thickness that maintains structural integrity. Typically, the thin film has a thickness of approximately 0.1 to approximately 1.0 millimeters and the aperture(s) are shaped as described above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A device for minimizing wind-induced noise in a microphone, comprising:

A) a housing having a recessed area shaped to accommodate a microphone transducer;

B) the microphone transducer, situated within the recessed area wherein a thin film is detachably affixed on a top surface of the microphone transducer, and wherein the top surface of the microphone transducer is flush with a top of the recessed area and the microphone transducer is affixed to the sides of the recessed area, for receiving sound, wherein the thin film has at least one aperture for allowing sound to impinge on the microphone transducer, and wherein the thin film has a minimal thickness that maintains structural integrity.

2. The device of claim 1 wherein the thin film has a thickness of approximately 0.1 to approximately 1.0 millimeters.

3. The device of claim 1 wherein the wind-induced noise is caused by wind exceeding 5 miles per hour.

4. The device of claim 1 wherein each aperture is one of:

A) round;

B) square;

C) rectangular; and

D) oblong.

5. A method for providing a device for minimizing wind-induced noise in a microphone, comprising the steps of:

for a housing having a recessed area shaped to accommodate a microphone transducer, A) utilizing the microphone transducer to receive sound, wherein the microphone transducer is situated within the recessed area wherein a thin film is detachably affixed on a top surface of the microphone transducer, and wherein the top surface of the microphone transducer is flush with a top of the recessed area and the microphone transducer is affixed to the sides of the recessed area; and B) using the thin film detachably affixed on the top surface of the microphone transducer, wherein the thin film has at least one aperture, to allow sound to impinge on the microphone transducer, and the thin film has a minimal thickness that maintains structural integrity.

6. The method of claim 5 wherein the thin film has a thickness of approximately 0.1 to approximately 1.0 millimeters.

7. The method of claim 5 wherein the wind-induced noise is caused by wind exceeding 5 miles per hour.

8. The method of claim 5 wherein each aperture is one of:

A) round;

B) square;

C) rectangular; and

D) oblong.

* * * * *